US009704470B2

(12) United States Patent
Raja et al.

(10) Patent No.: US 9,704,470 B2
(45) Date of Patent: Jul. 11, 2017

(54) METHOD AND APPARATUS FOR NONLINEAR COMPENSATION IN AN ACTIVE NOISE CONTROL SYSTEM

(71) Applicant: UNIVERSITI PUTRA MALAYSIA, Serdang, Selangor (MY)

(72) Inventors: Mohd Kamil Raja Ahmad Raja, Serdang (MY); Abdulredha Sahib Mouayad, Serdang (MY); Ghasemi Dehkordi Sepehr, Serdang (MY)

(73) Assignee: UNIVERSITI PUTRA MALAYSIA, Selangor (MY)

( * ) Notice: Subject to any disclaimer, the term of this patent is extended or adjusted under 35 U.S.C. 154(b) by 0 days.

(21) Appl. No.: 15/027,068

(22) PCT Filed: Oct. 1, 2014

(86) PCT No.: PCT/MY2014/000244
§ 371 (c)(1),
(2) Date: Apr. 4, 2016

(87) PCT Pub. No.: WO2015/050431
PCT Pub. Date: Apr. 9, 2015

(65) Prior Publication Data

US 2016/0240184 A1 Aug. 18, 2016

(30) Foreign Application Priority Data

Oct. 2, 2013 (MY) ..... PI2013701854

(51) Int. Cl.
*G10K 11/16* (2006.01)
*G10K 11/178* (2006.01)

(52) U.S. Cl.
CPC .... *G10K 11/178* (2013.01); *G10K 2210/3022* (2013.01); *G10K 2210/3035* (2013.01);
(Continued)

(58) Field of Classification Search
CPC ..... G10K 11/178
See application file for complete search history.

(56) References Cited

U.S. PATENT DOCUMENTS 5,386,472 A * 1/1995 Pfaff ..... F01N 1/065 381/71.12
7,062,050 B1 6/2006 Pompei
(Continued)

FOREIGN PATENT DOCUMENTS

CN 101276207 10/2008
EP 0973151 1/2000
(Continued)

OTHER PUBLICATIONS

International Search Report of PCT/MY2014/000244, dated Feb. 10, 2015, 1 page total.

*Primary Examiner* — Simon King
(74) *Attorney, Agent, or Firm* — Hamre, Schumann, Mueller & Larson. P.C.

(57) ABSTRACT

A self tuned apparatus (100) for active noise control includes a first transducer (105) and a second transducer (110), a noise controlling module (115), a power amplifier (120) and a first loudspeaker (125) and a second loudspeaker (130) coupled to the power amplifier (120). The noise controlling module (115) is coupled to the first transducer (105) and the second transducer (110). The power amplifier (120) is coupled to the noise controlling module (115). Particularly, the noise controlling module (115) employs at least one control algorithm.

20 Claims, 12 Drawing Sheets

(52) U.S. Cl.
CPC ..... *G10K 2210/3039* (2013.01); *G10K 2210/30391* (2013.01)

(56) References Cited

U.S. PATENT DOCUMENTS

| | | | | |
|---|---|---|---|---|
| 2006/0133620 | A1 | 6/2006 | Lashkari | |
| 2009/0022336 | A1* | 1/2009 | Visser | G10L 21/0272 381/94.7 |
| 2010/0280824 | A1* | 11/2010 | Petit | G10L 21/0208 704/214 |
| 2011/0312290 | A1* | 12/2011 | Beeler | H04B 7/18513 455/114.3 |
| 2012/0195450 | A1* | 8/2012 | Foeh | H04R 25/453 381/318 |
| 2014/0044275 | A1* | 2/2014 | Goldstein | H04R 3/002 381/71.6 |
| 2014/0269989 | A1* | 9/2014 | Santucci | H04B 1/0475 375/296 |

FOREIGN PATENT DOCUMENTS

| | | |
|---|---|---|
| GB | 2308898 | 7/1997 |
| WO | 9750078 | 12/1997 |

* cited by examiner

METHOD AND APPARATUS FOR NONLINEAR COMPENSATION IN AN ACTIVE NOISE CONTROL SYSTEM

TECHNICAL FIELD

Embodiments of the present invention generally relate to an amplifier design and an active noise control system, and more particularly, to method and apparatus for controlling noise actively, echo cancellation, and communication by compensating for at least one secondary path non-linearity in an active noise control system.

BACKGROUND ART

Nonlinear active noise control design has been the subject of constant research and development. A conventional noise attenuating method is to attenuate noises by actively combining, in amplitude, generated sounds against the noises. For example, noises can be cancelled by generating sounds equal in amplitude but opposite in phase to the noises through for example an FIR filter, radiating the sounds from a speaker, and combining the noises with the sounds opposite to the noises in amplitude.

Generally, it is known in the art of active noise control (ANC) systems, that such systems are used to electronically sense and cancel undesired noise (or vibration) from noise producing sources such as fans, blowers, electronic transformers, engines, etc. One methodology for sensing and cancellation involves a "collocated" approach where a sensor (such as a microphone) and an actuator (such as a speaker) are located along the same plane as the wave-front plane of the disturbance noise (or vibration).

Numerous approaches in the nonlinear active noise control design revolves around designing the controller directly using general nonlinear models like Volterra model without going through any nonlinear modeling process. However, the said approach does not reveal the degree of nonlinearity, a knowledge which is useful at the design stage. In addition, designing Volterra filters is computationally intensive.

CN101276207 patent titled "multivariable non-linear system prediction function control method based on hammerstein model" discloses a controlling method of a multivariate nonlinear system prediction function based on the hammerstein model, characterized in that the method includes the steps of establishing the hammerstein model according to the process characteristic and the input output data, solving the prediction function control rate of the multivariate linear subsystem according to the hammerstein model linear part model parameters, set values and practical process output of, solving the equation V(k)=F(U(k)) to obtain optimal control law U(k) according to the hammerstein model nonlinear part model parameters and the multivariate linear multivariate nonlinear system prediction function control rate, and solving and implementing the optimal control law according to multivariate nonlinear system prediction function controller. However, the controller is designed using state space approach and relies on the use of an optimization procedure over a prediction horizon. This optimization procedure is time consuming and limits the applicability in real time implementation. Moreover, the exact function used in the nonlinear part of the Hammerstein model is not specified.

GB2308898 patent titled "adaptive nonlinear controller for electromechanical or electroacoustic system" discloses a method that revolves around Volterra filters and includes an arrangement of the linear and nonlinear blocks to improve the use of processor memory and subsequently reduce the computational load. However, when compared to other controller structures, like the bilinear filters and functional link neural network, the controller design process using Volterra filters is computationally intensive due to the large number of parameters that needs to be identified.

U.S. Pat. No. 7,062,050 patent titled "preprocessing method for nonlinear acoustic system" discloses a method of processing an audio signal in a nonlinear acoustic system to reduce distortion in corresponding regenerated audio signals. Particularly, the present invention involves the design of a predistorter to compensate the effect of nonlinear distortion of the audio source which requires inverting the nonlinear model that causes the distortion. However, the method of modeling this nonlinear distorting function has not been clearly outlined. In addition, the type and degree of nonlinearity strength may have to be known in advance.

WIPO Patent Application WO/1997/050078 titled "nonlinear reduced-phase filters for active noise control" discloses the design of a non adaptive fixed controller using a nonlinear reset logic filter. In active noise control, adaptive filter is almost exclusively used due to the time varying nature of the noise.

There remains a need in the art for a method and apparatus to model and control nonlinearity of amplifier and loudspeaker.

DISCLOSURE OF THE INVENTION

Embodiments of the present invention aim to provide a self-tuned apparatus for controlling active noise by compensating for secondary path non-linearities caused by at least one saturation effect in an active noise control system, and the apparatus includes a first transducer and a second transducer, the first transducer being electrically coupled to the second transducer, wherein the first transducer and the second transducer are configured to receive a first acoustic signal and a second acoustic signal respectively, a noise controlling module coupled to the first transducer and the second transducer, wherein the noise controlling module employs at least one control algorithm, at least one power amplifier coupled to the noise controlling module, and a first loudspeaker and a second loudspeaker coupled to the power amplifier.

Embodiments of the present invention further aim to provide a self-tuned method for controlling active noise by compensating for at least one secondary path non-linearity caused by at least one saturation effect in an active noise control system, the method includes the steps of modeling the at least one secondary path non-linearity with saturation nonlinearity in at least one of a loudspeaker and/or a power amplifier, evaluating a degree of nonlinearity from an identified secondary path model, and determining at least one control algorithm for saturation nonlinearity in the at least one of the loudspeaker and/or the power amplifier.

In accordance with an embodiment of the present invention, the apparatus is configured for modeling a nonlinear secondary path.

In accordance with an embodiment of the present invention, the nonlinear secondary path and a degree of nonlinearity are modeled using tangential hyperbolic function (THF).

In accordance with an embodiment of the present invention, the at least one control algorithm determined is nonlinear FXLMS family of algorithm.

In accordance with an embodiment of the present invention, the at least one control algorithm determined is Leaky FXLMS family of algorithm and/or Minimum output variance FXLMS family of algorithm.

While the invention is described herein by way of example using several embodiments and illustrative drawings, those skilled in the art will recognize that the invention is not limited to the embodiments of drawing or drawings described, and are not intended to represent the scale of the various components. Further, some components that may form a part of the invention may not be illustrated in certain figures, for ease of illustration, and such omissions do not limit the embodiments outlined in any way. It should be understood that the drawings and detailed description thereto are not intended to limit the invention to the particular form disclosed, but on the contrary, the invention is to cover all modification, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to. Further, the words "a" or "an" mean "at least one" and the word "plurality" means one or more, unless otherwise mentioned.

DESCRIPTION OF DRAWINGS AND BEST MODE FOR CARRYING OUT THE INVENTION

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

These and other features, benefits and advantages of the present invention will become apparent by reference to the following text figures, with like reference numbers referring to like structures across the views, wherein.

Embodiments of the present invention aim to provide a method and apparatus to compensate the secondary path nonlinearities in active noise control systems. It is a known fact that the secondary path nonlinearities are caused by the saturation effects of either the audio power amplifier, loudspeakers, digital to analog converters, or analog to digital converters. The novelty of the present method revolves around the modeling aspect of the secondary path which is represented by a Hammerstein and Weiner structures where a tangential hyperbolic function (THF) is used to model the nonlinear parts using an adaptive algorithm. Particularly, the nonlinearity degree is calculated from the modeled THF. Subsequently, the calculated nonlinearity degree is used to design an active noise controller using either Nonlinear Filtered-x Least Mean Square (NLFXLMS) family of algorithm, Leaky Filtered-x Least Mean Square (LFXLMS) family of algorithm or Minimum Output Variance Filtered-x Least Mean Square (MOVFXLMS) family of algorithm.

Figure 1A:
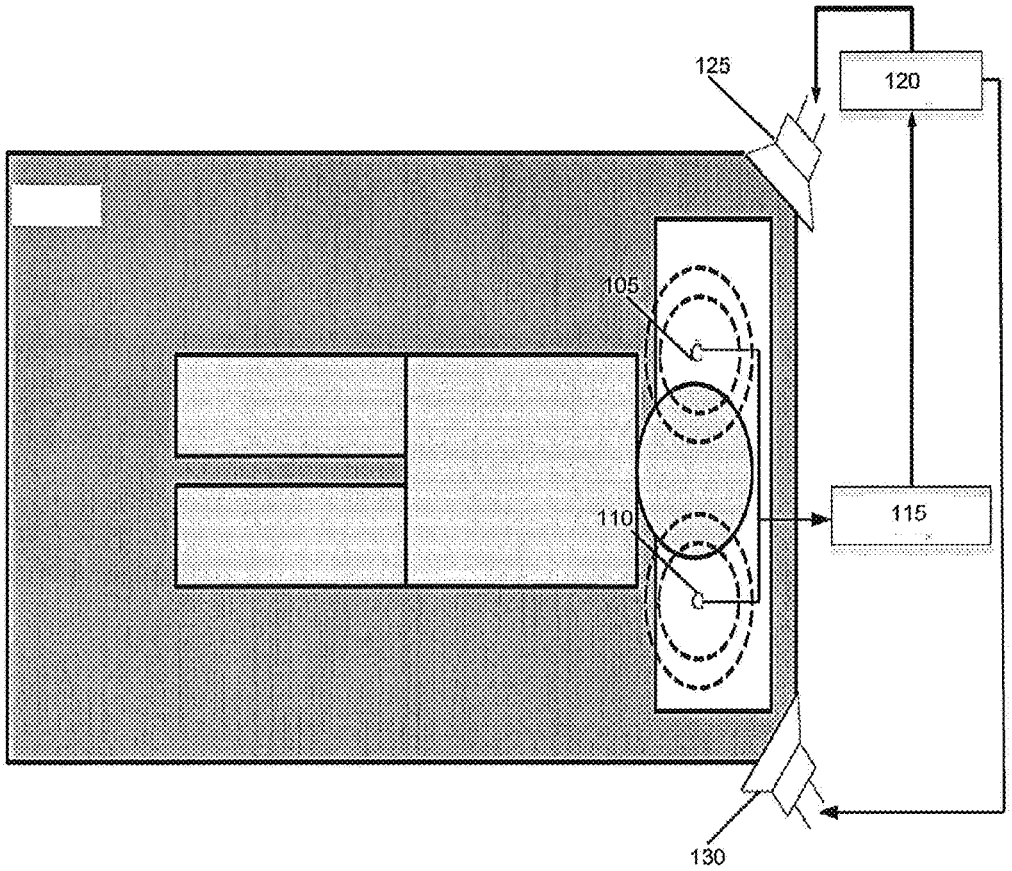
FIG. 1A illustrates a schematic view of a nonlinear active noise cancellation apparatus, in accordance with an embodiment of the present invention.
Figure 1B:
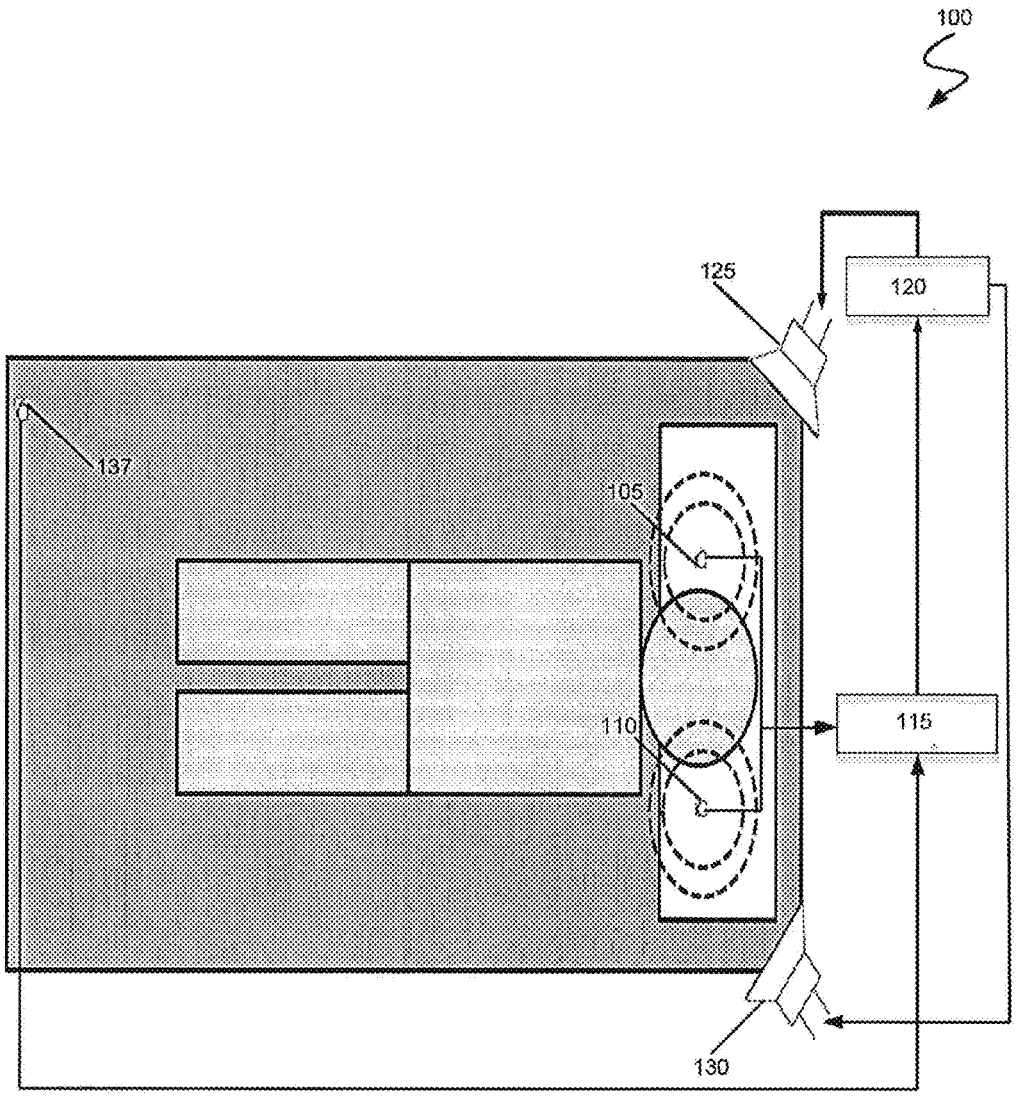
FIG. 1B illustrates a schematic view of a nonlinear active noise cancellation apparatus, in accordance with another embodiment of the present invention.

FIG. 1B illustrates a schematic view of a nonlinear active noise cancellation apparatus 100, in accordance with an embodiment of the present invention. Particularly, the self-tuned apparatus 100 for controlling active noise by compensating for secondary path non-linearities caused by at least one saturation effect in an active noise control system, includes a first transducer 105 and a second transducer 110, a noise controlling module 115, a power amplifier 120 and a first loudspeaker 125 and a second loudspeaker 130 coupled to the power amplifier 120. In operation, the first transducer 105 is electrically coupled to the second transducer 110, and the first transducer 105 and the second transducer 110 are configured to receive a first acoustic signal and a second acoustic signal. The noise controlling module 115 is coupled to the first transducer 105 and the second transducer 110. The power amplifier 120 is coupled to the noise controlling module 115. Particularly, the noise controlling module 115 employs at least one control algorithm. The saturation is due to the use of low cost power amplifier 120 and the loudspeakers 125,130. However, the present invention is not limited to cover nonlinearity due to low power cost and may include other conditions other than low power cost.

Moreover, the degree of saturation effects (nonlinearity) is extracted from the models such that there is no need to have a prior knowledge or make any guesses or assumption of the actual nonlinearity strength. However, it should be noted that active noise control is sometimes referred as active noise cancellation.

In accordance with an embodiment of the present invention, the control algorithm is nonlinear Filtered-X Least Mean Square (NLFXLMS) family of algorithm. The nonlinear Filtered-X Least Mean Square (NLFXLMS) is applied for nonlinear active noise control (NANC) in real time using the estimated degree of nonlinearity.

In accordance with another embodiment of the present invention, the control algorithm determined is Leaky FXLMS family of algorithm and/or Minimum output variance FXLMS family of algorithm. The Minimum Output Variance FXLMS family of algorithms and the Leaky FXLMS family algorithms with optimum leakage factor are implemented using the degree of nonlinearity modeled using tangential hyperbolic function (THF). Particularly, implementing the minimum output variance (MOVFXLMS) and Leaky FXLMS (LFXLMS) algorithms with optimum leakage factor using the degree of nonlinearity provides low computational complexity algorithms with high range of noise reduction for NANC structures. Subsequently, the automatic self tuning capability of the present invention for NANC allows the system to be used and operated by any novice user.

In accordance with an embodiment of the present invention, the apparatus 100 is configured for modeling a nonlinear secondary path. The nonlinear secondary path and a degree of nonlinearity are modeled using tangential hyperbolic function (THF). In addition, the modeling of the at least one secondary path non-linearity with saturation nonlinearity is performed by selecting one of a Hammerstein model structure and a Wiener model structure in presence of the loudspeaker 125, 130 and/or the power amplifier 120.

In accordance with another embodiment of the present invention, the active noise control system includes feedforward architectures and feedback architectures for both single systems and multivariable systems. A reference microphone 137 is placed near noise source for feedforward implementation as illustrated in FIG. 1A of the present invention. The reference microphone 137 is positioned at an arbitrary location where there is zone of cancelation.

In accordance with another embodiment of the present invention, the THF modeling techniques, NLFXLMS controller design, MOVFXLMS and LFXLMS algorithms are applicable by utilizing the reference microphone 137 where the zone of cancelation can be placed at an arbitrary location.

In accordance with an embodiment of the present invention, the first transducer 105, and the second transducer 110 are a microphone.

Figure 1C:
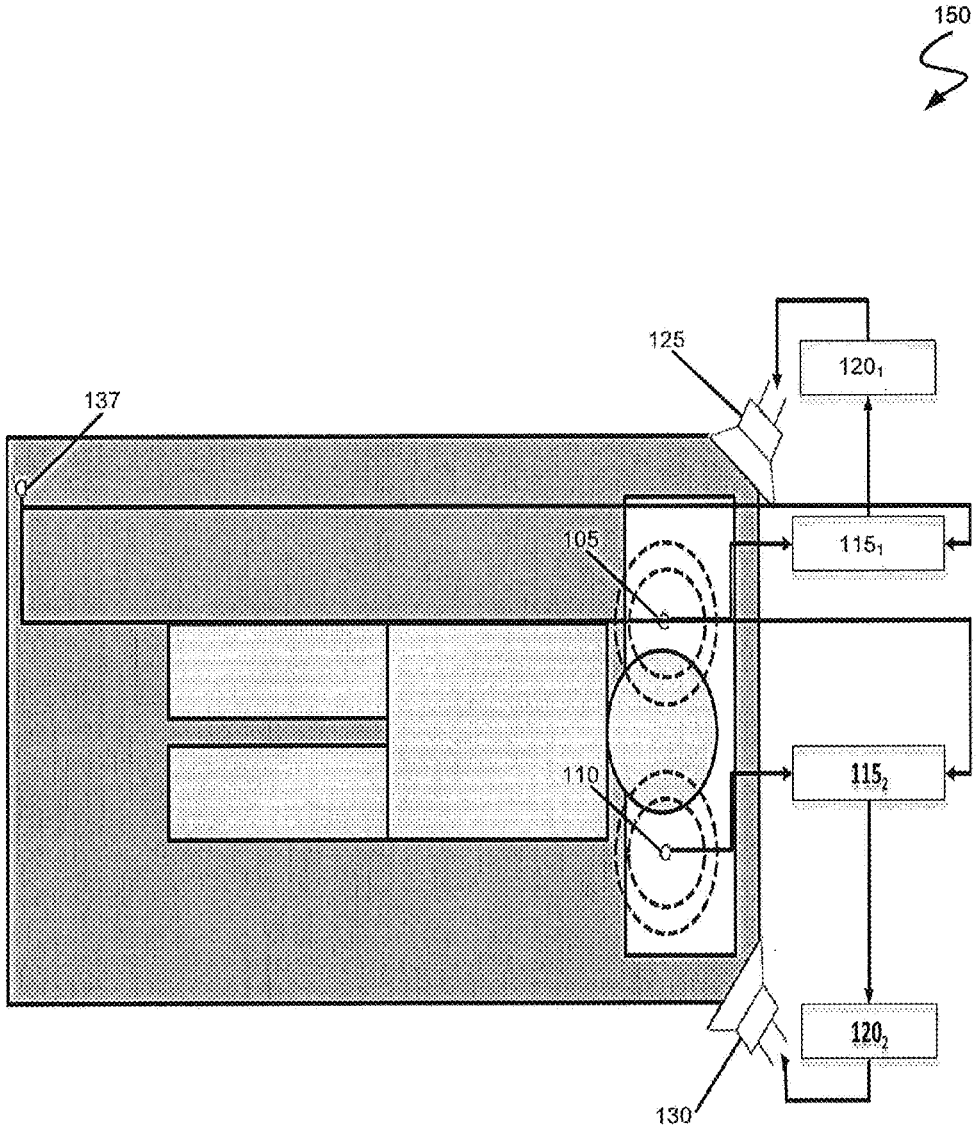
FIG. 1C illustrates a schematic view of a nonlinear active noise cancellation apparatus, in accordance with yet another embodiment of the present invention.

FIG. 1C illustrates a schematic view of a nonlinear active noise cancellation apparatus 150, in accordance with yet another embodiment of the present invention. The nonlinear active noise cancellation apparatus 150 includes two power amplifiers $\mathbf{120}_1$, $\mathbf{120}_2$ and two noise controlling modules $\mathbf{115}_1$, $\mathbf{115}_2$. However, the present invention is not limited to employ two noise controlling modules $\mathbf{115}_1$, $\mathbf{115}_2$ and can utilize more than two noise controlling modules $\mathbf{115}_1$, $\mathbf{115}_2$ to embed the one or more control algorithms of the present invention.

Figure 2:
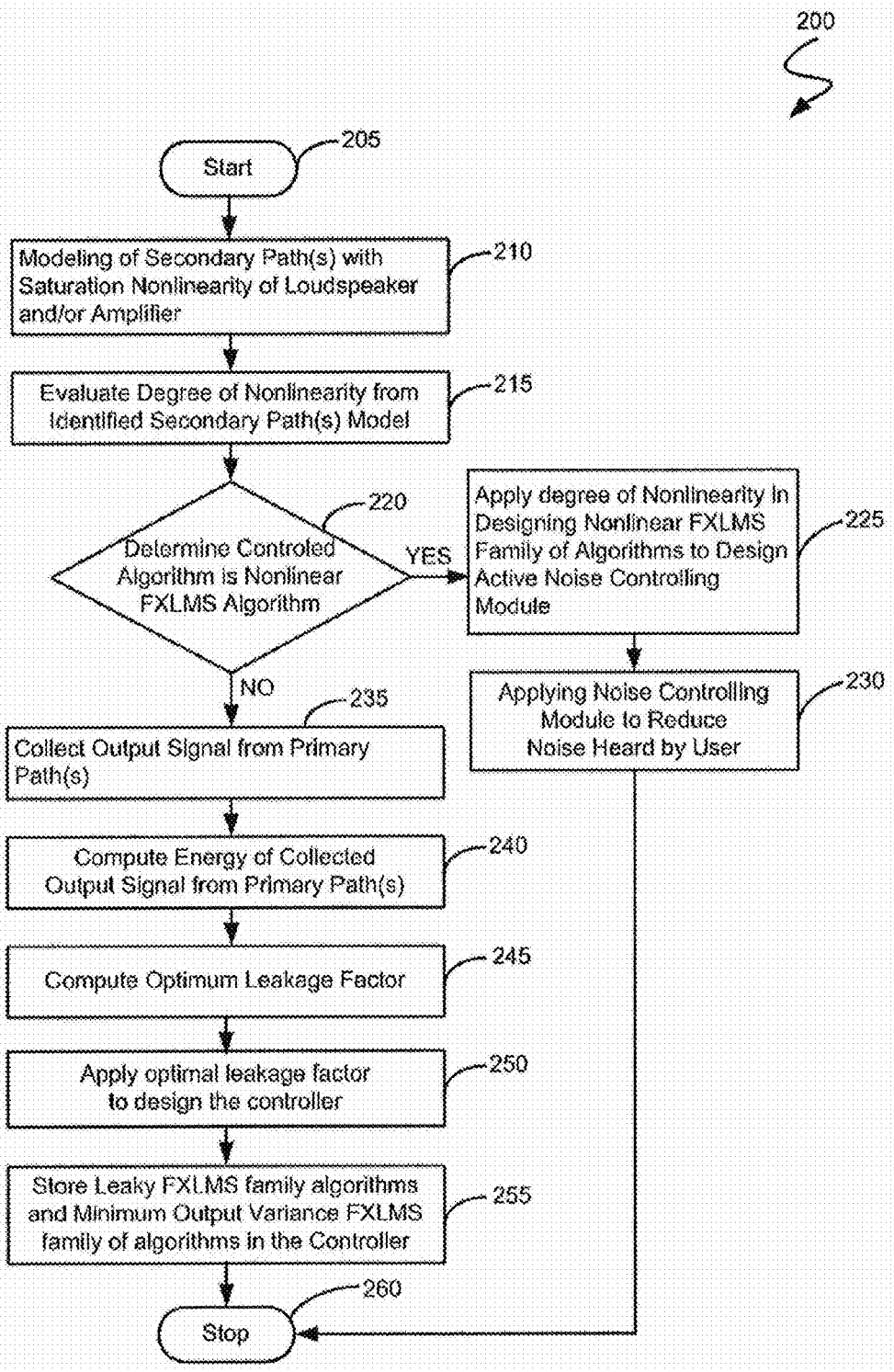
FIG. 2 illustrates a flowchart of a self-tuned method for controlling active noise by compensating for at least one secondary path non-linearity caused by at least one saturation effect in an active noise control system, in accordance with an embodiment of the present invention.

FIG. 2 illustrates a flowchart of a self tuned method 200 for controlling active noise by compensating for at least one secondary path non-linearity caused by at least one saturation effect in an active noise control system, in accordance with an embodiment of the present invention. The self tuned method 200 for controlling active noise by compensating for at least one secondary path non-linearity caused by at least one saturation effect in an active noise control system starts at step 205 and proceeds to step 210. At step 210, the method 200 includes modeling the at least one secondary path non-linearity with saturation nonlinearity in at least one of the loudspeakers 125,130 and/or the power amplifier 120. The method 200 proceeds to step 215. At step 215, a degree of nonlinearity from an identified secondary path model is evaluated. The method 200 proceeds to step 220. At step 220, a determination is made to determine at least one control algorithm for saturation nonlinearity in the at least one of the loudspeaker and/or the power amplifier.

In accordance with an embodiment of the present invention, if the determined control algorithm for saturation nonlinearity in the loudspeaker and/or the power amplifier is nonlinear FXLMS family of algorithm, the method 200 proceeds to step 225. At step 225, the degree of nonlinearity is applied in designing nonlinear FXLMS family of algorithms to design the active noise controlling module 115. Particularly, the nonlinear FXLMS family of algorithm is designed iteratively using the information of the degree of nonlinearity until the controller 115 converges. The method 200 proceeds to step 230. At step 230, the noise controlling module 115 is applied to reduce noise heard by a subject user. The method 200 proceeds to step 260. At step 260, the method 200 ends.

In accordance with another embodiment of the present invention, if the determined control algorithm for saturation nonlinearity in the loudspeaker and/or the power amplifier is not nonlinear FXLMS family of algorithm, the method 200 proceeds to step 235. At step 235, the output signal is collected from a primary path. At step 240, energy of collected output signal from the primary path is computed. The method 200 proceeds to step 245. At step 245, an optimum leakage factor using the energy of the output signal of the primary path and the degree of nonlinearity is computed. At step 250, the computed optimum leakage factor is applied in forming at least one of the Leaky FXLMS family algorithms and the Minimum Output Variance FXLMS family of algorithms to design the controller 115. The method 200 proceeds to step 255. At step 255, the Leaky FXLMS family algorithms and the Minimum Output Variance FXLMS family of algorithms are stored in a processor of the noise controlling module 115. Subsequently, the noise controlling module 115 is applied to reduce noise heard by the subject user. The method 200 proceeds to step 260. At step 260, the method 200 ends.

Figure 3:
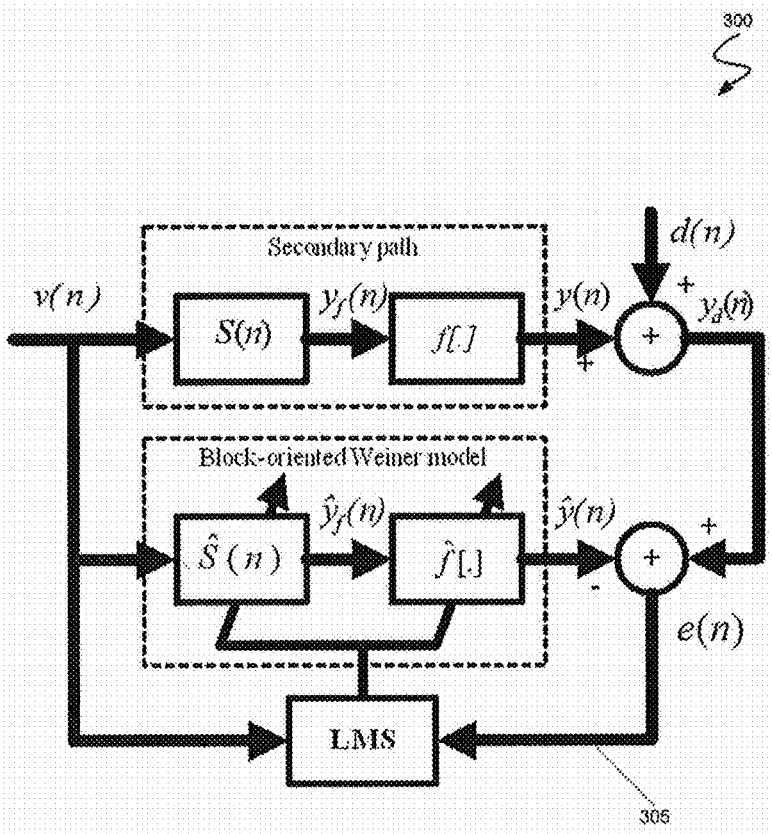
FIG. 3 illustrates an Active Noise Control (ANC) block diagram for the modeling of loudspeaker nonlinearity or Wiener structure using tangential hyperbolic function (THF), in accordance with an embodiment of the present invention.

FIG. 3 illustrates an Active Noise Control (ANC) block diagram 300 for the modeling of loudspeaker nonlinearity using tangential hyperbolic function (THF), in accordance with an embodiment of the present invention. The white noise or modeling signal is modeled and illustrated by symbol v(n). The secondary path S(n) is represented by weiner structure in this embodiment and the estimated secondary path is represented by symbol $\hat{S}(n)$. The memory less saturation function is illustrated by symbol f[.]. The Primary path output is represented by symbol d(n). The error signal is represented by symbol e(n). In one embodiment, the illustration 305 indicates single and/or multichannel connections.

Figure 4:
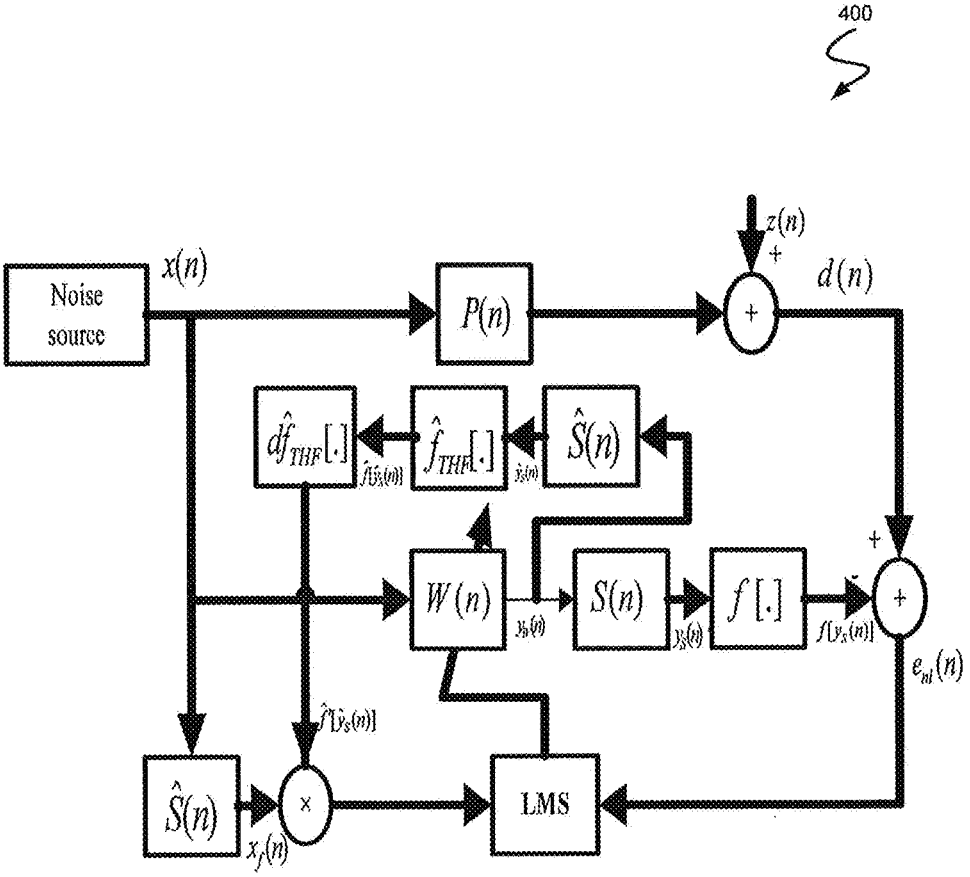
FIG. 4 illustrates an ACTIVE NOISE CONTROL (ANC) block diagram for feedforward control of loudspeaker nonlinearity, in accordance with an embodiment of the present invention.

FIG. 4 illustrates an ACTIVE NOISE CONTROL (ANC) block diagram 400 for feedforward control of loudspeaker nonlinearity, in accordance with an embodiment of the present invention. The estimated memory less saturation function based on THF is represented by symbol $\hat{f}_{THF}[.]$. The derivative of estimated memory less saturation function is represented by symbol $d\hat{f}[.]$. The Controller is represented by symbol W(n). The primary path is represented by symbol P(n). The distortion signal is represented by symbol z(n). The primary path output is represented by symbol d(n). The primary source noise signal is represented by symbol x(n).

Figure 5:
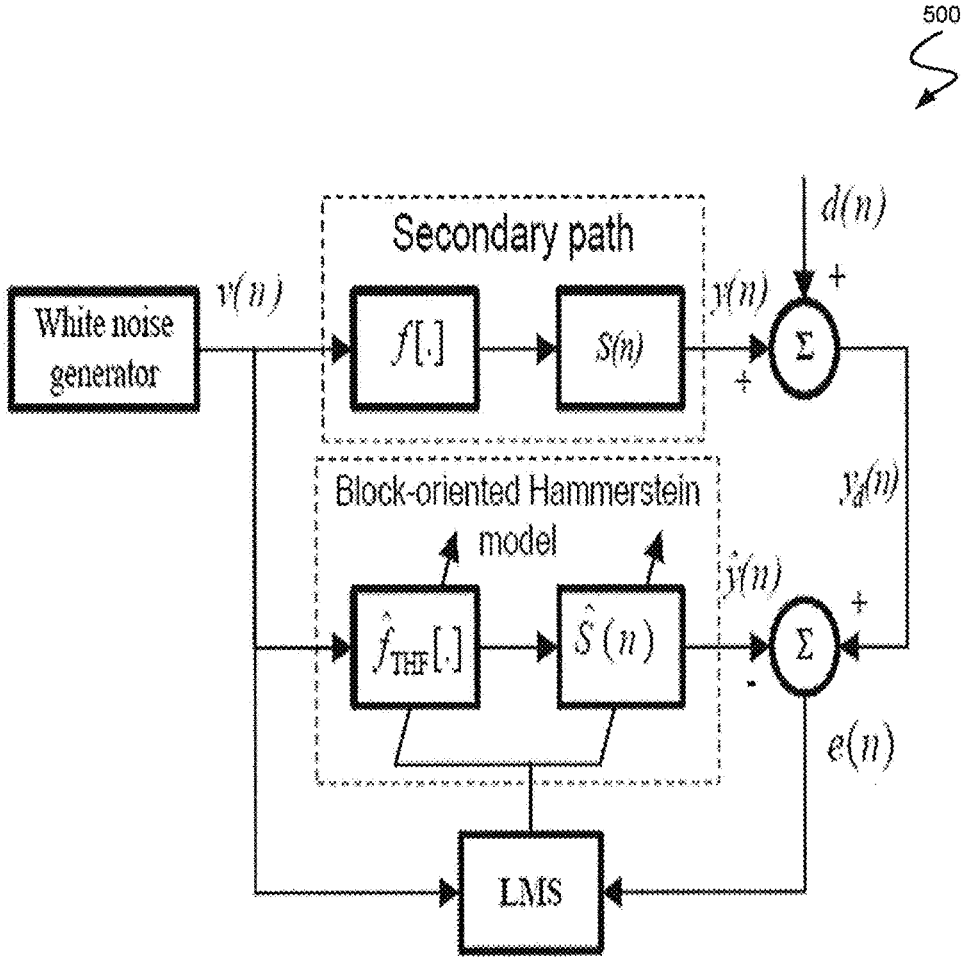
FIG. 5 illustrates an ACTIVE NOISE CONTROL (ANC) block diagram for the modeling of amplifier nonlinearity or Hammerstein structure using tangential hyperbolic function (THF), in accordance with an embodiment of the present invention.

FIG. 5 illustrates an ACTIVE NOISE CONTROL (ANC) block diagram 500 for the modeling of amplifier nonlinearity using tangential hyperbolic function (THF), in accordance with an embodiment of the present invention. The secondary path S(n) and the estimated secondary path $\hat{S}(n)$ is represented by Hammerstein structure in this embodiment.

Figure 6:
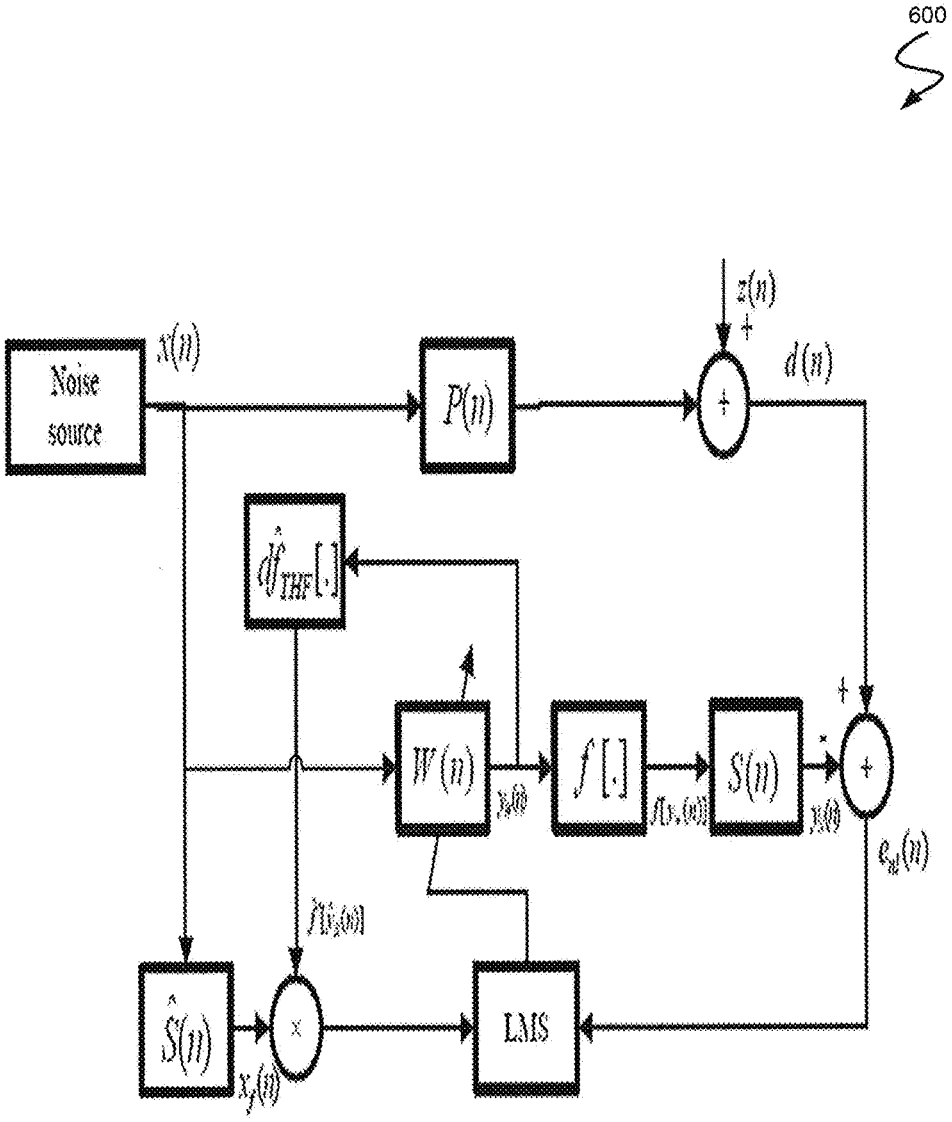
FIG. 6 illustrates an ACTIVE NOISE CONTROL (ANC) block diagram for feedforward control of amplifier nonlinearity, in accordance with an embodiment of the present invention.
Figure 7:
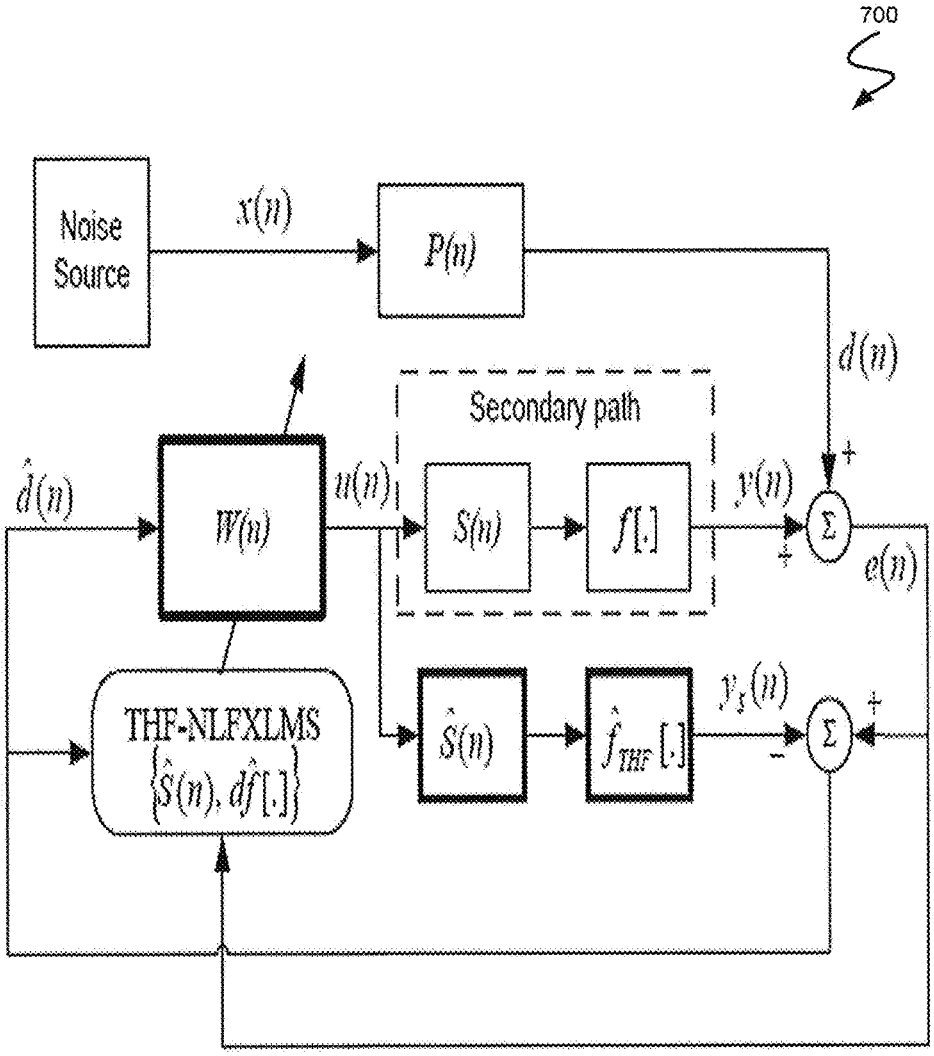
FIG. 7 illustrates an ACTIVE NOISE CONTROL (ANC) block diagram of feedback internal model control (IMC) for loudspeaker nonlinearity, in accordance with an embodiment of the present invention.
Figure 8:
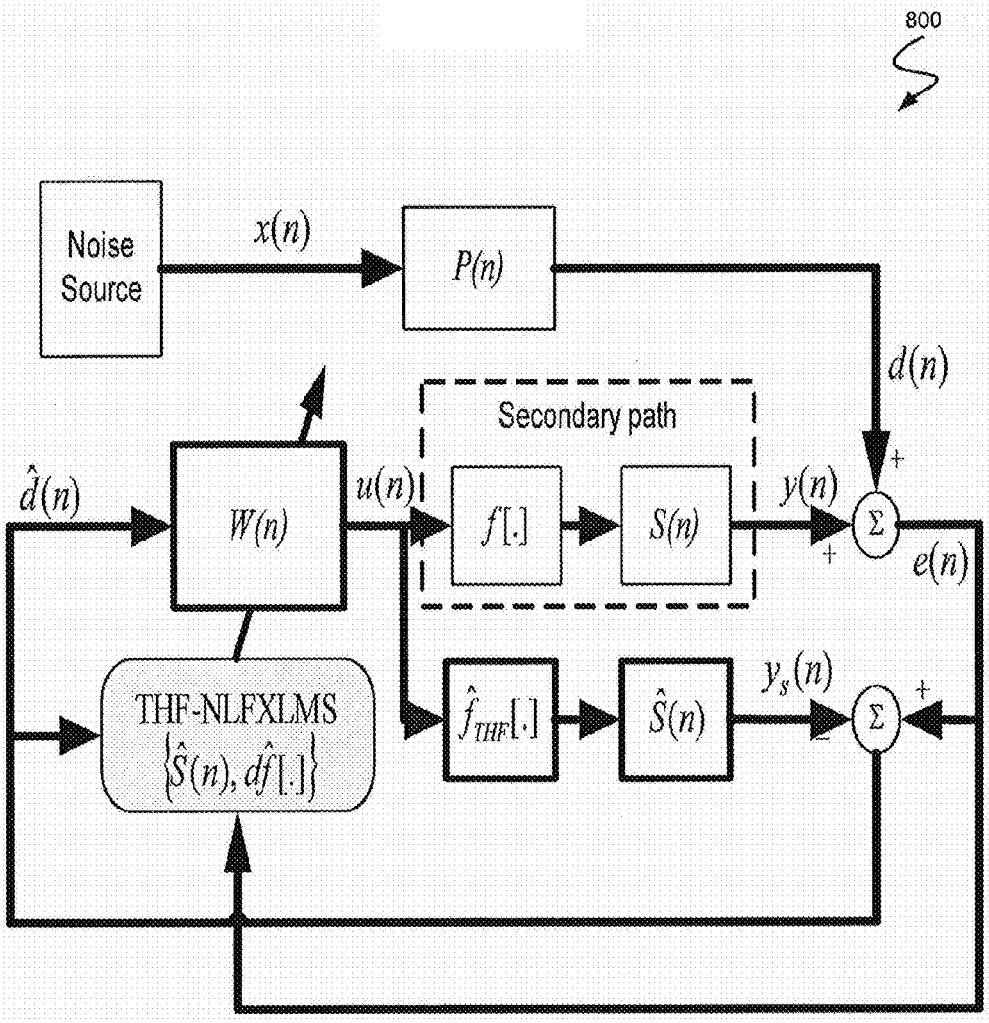
FIG. 8 illustrates an ACTIVE NOISE CONTROL (ANC) block diagram of feedback internal model control (IMC) for amplifier nonlinearity, in accordance with an embodiment of the present invention.
Figure 9:
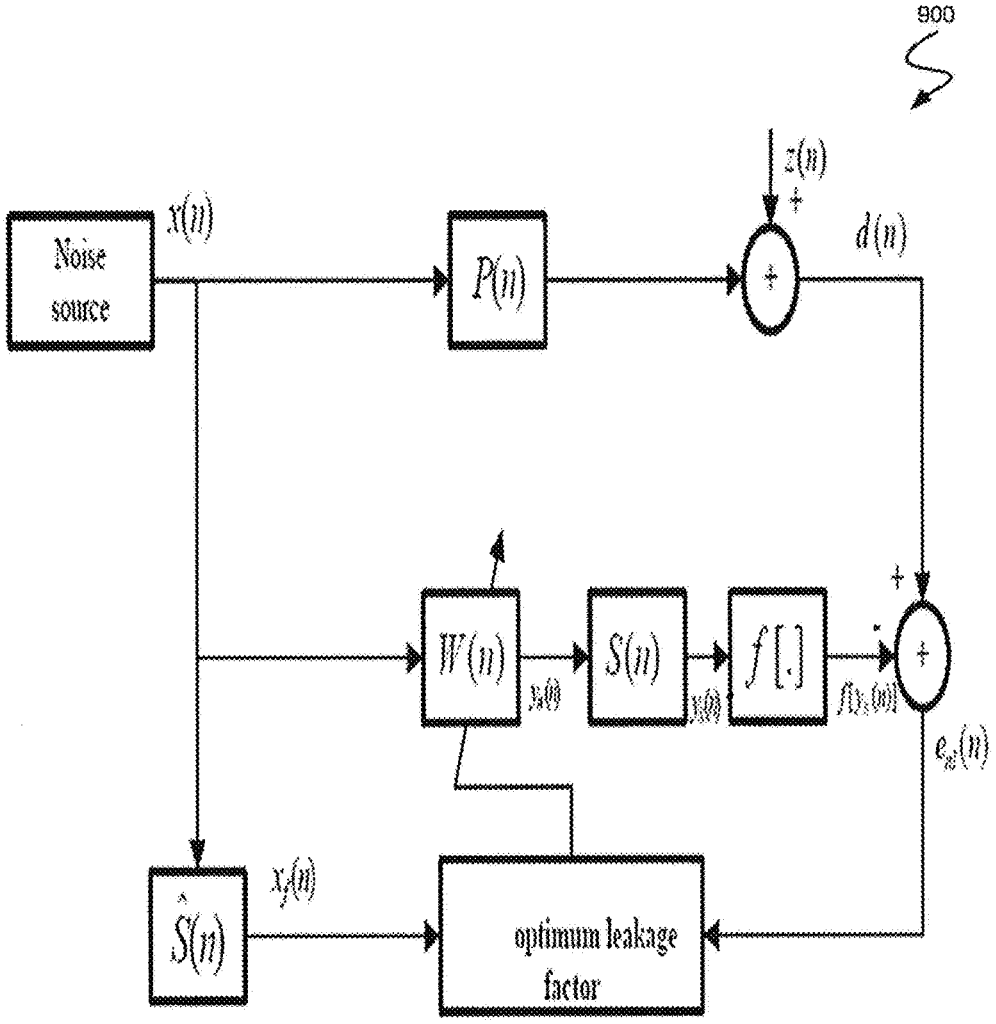
FIG. 9 illustrates an ACTIVE NOISE CONTROL (ANC) block diagram of feedforward control using Leaky FXLMS or Minimum Output Variance FXLMS with optimum leakage factor, in accordance with an embodiment of the present invention.

FIG. 6 illustrates an ACTIVE NOISE CONTROL (ANC) block diagram 600 for feedforward control of amplifier nonlinearity, FIG. 7 illustrates an ACTIVE NOISE CONTROL (ANC) block diagram 700 of feedback internal model control (IMC) for loudspeaker nonlinearity, FIG. 8 illustrates an ACTIVE NOISE CONTROL (ANC) block diagram 800 of feedback internal model control (IMC) for amplifier nonlinearity, and FIG. 9 illustrates an ACTIVE NOISE CONTROL (ANC) block diagram 900 of feedforward control using Leaky FXLMS or Minimum Output Variance FXLMS with optimum leakage factor, in accordance with an embodiment of the present invention.

Figure 10:
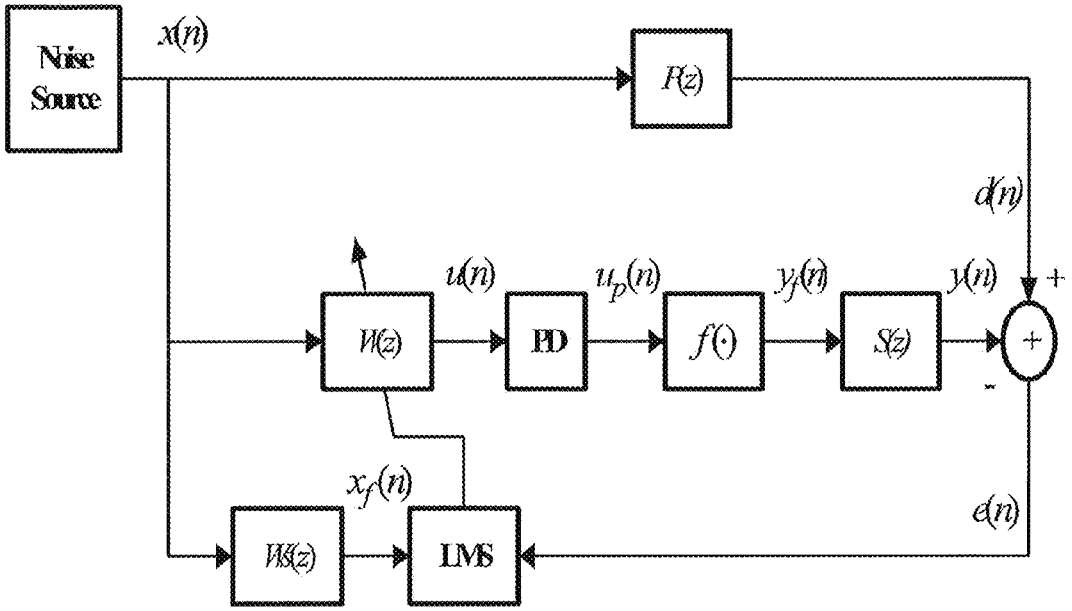
FIG. 10 illustrates a circuit diagram of a FXLMS ANC structure with a pre-distorter, in accordance with another embodiment of the present invention.

FIG. 10 illustrates a circuit diagram of a FXLMS ANC structure with a pre-distorter, in accordance with another embodiment of the present invention. u(n), $u_p(n)$,$y_f(n)$, x(n), and $x_f(n)$ represent the controller output signal, pre-distorted controller output signal, loudspeaker output signal, reference signal, and the filtered reference signal respectively. Particularly, the controller weights are updated using the conventional linear FXLMS algorithm. The objective of the pre-distorter is to compensate for the nonlinearity effect of the nonlinear function $f(\bullet)$. In order to achieve this objective, the pre-distorter has to be designed such that $$y_f(n) \cong u(n)$$

The predistorter can be designed by inverting the modeled THF function. Moreover, coupling the inverted THF with the nonlinear function of the amplifier or loudspeaker would linearise the secondary path. Consequently, the transfer function of the pre-distorter has to be equal to the inverse of the true nonlinear transfer function. Furthermore, the predistorter is designed by inverting the THF that has been modeled using the modeling approach as discussed in FIG. 3 or FIG. 5 of the present invention. Therefore, the present invention provides a design methodology of nonlinear controller with low computational cost to compensate the effects of saturation of the loudspeaker or/and amplifier for feedforward and feedback active noise control system. The secondary path and the degree of nonlinearity are modeled using tangential hyperbolic function (THF). Moreover, the present invention has an automatic capability which allows the control algorithms to be implemented without human intervention. Further, the method and apparatus of the present invention are applicable for feedforward and feedback architectures for both single and multivariable systems. Particularly, the whole process of controller design can be implemented automatically without requiring input from user in the form of degree of nonlinearity and leakage factor. Moreover, the advantage of modeling the nonlinear secondary path with the tangential hyperbolic function (THF) is such that degree of nonlinearity strength can be estimated and that it need not be known or guessed or assumed to take certain numerical value in advance. In addition, the present apparatus works at room temperature and at standard atmospheric pressure.

The present invention can be utilized to manufacture a portable self-tuned low cost active noise control system to cancel any low frequency noise for e.g. traffic noise pollution of about less than 500 Hz. Moreover, the present invention can be placed in housing areas and residence in high rise apartment units which are built and constructed very near to the major roads. In addition, the present invention can be utilized to design active noise control headset and headrest, echo cancellation controllers, active vibration control system, communication filters, modeling of nonlinear processes and design pre-distorter filters. Further, the present invention can be utilized for echo cancelation. Those of ordinary skill in the art will appreciate that various embodiments of the present invention may be applied to active vibration control since this application and active noise control are closely related.

While an illustrative embodiment of the present has been shown in the drawings and described in considerable detail, it should be understood that there is no intention to limit the invention to the specific form disclosed. On the contrary the intention is to cover all modifications, alternative constructions, equivalents and uses falling within the spirit and scope of the invention as expressed in the appended claims.

The invention claimed is:

1. A self-tuned apparatus for controlling noise actively by compensating for at least one secondary path non-linearity caused by at least one saturation effect in an active noise control system, said apparatus comprising:

a first transducer and a second transducer, said first transducer being electrically coupled to said second transducer, wherein said first transducer and said second transducer are configured to receive a first acoustic signal and a second acoustic signal respectively;

a noise controlling module coupled to said first transducer and said second transducer, wherein said noise controlling module employs at least one control algorithm;

at least one power amplifier coupled to said noise controlling module; and a first loudspeaker and a second loudspeaker coupled to said power amplifier, wherein said apparatus is configured for modeling a nonlinear secondary path and allows estimation of a degree of nonlinearity to be implemented in said noise controlling module;

said nonlinear secondary path and the degree of nonlinearity are modeled using tangential hyperbolic function (THF); and modeling of said at least one secondary path non-linearity with saturation nonlinearity is performed by selecting one of a Hammerstein model structure and a Wiener model structure in the presence of at least one of said first loudspeaker and said second loudspeaker and/or said power amplifier.

2. The apparatus of claim 1, wherein said active noise control system comprises feedforward architectures and feedback architectures for both single systems and multivariable systems.

3. The apparatus of claim 2, wherein said first transducer and said second transducer are a microphone.

4. The apparatus of claim 1, wherein said at least one control algorithm is nonlinear Filtered-X Least Mean Square (NLFXLMS) family of algorithms.

5. The apparatus of claim 1, wherein said at least one control algorithm determined is Leaky FXLMS family of algorithms and/or Minimum output variance FXLMS family of algorithms.

6. A self-tuned apparatus for controlling noise actively by compensating for at least one secondary path non-linearity caused by at least one saturation effect in an active noise control system, said apparatus comprising:

a first transducer and a second transducer, said first transducer being electrically coupled to said second transducer, wherein said first transducer and said second transducer are configured to receive a first acoustic signal and a second acoustic signal respectively;

a noise controlling module coupled to said first transducer and said second transducer, wherein said noise controlling module employs at least one control algorithm;

at least one power amplifier coupled to said noise controlling module; and a first loudspeaker and a second loudspeaker coupled to said power amplifier, wherein said at least one control algorithm determined is Leaky FXLMS family of algorithms and/or Minimum output variance FXLMS family of algorithms;

said Minimum output variance FXLMS family of algorithms and/or said Leaky FXLMS family algorithms are implemented using a degree of nonlinearity modeled using tangential hyperbolic function (THF).

7. The apparatus of claim 6, wherein said apparatus is configured for modeling a nonlinear secondary path and allows estimation of said degree of nonlinearity to be implemented in said noise controlling module.

8. The apparatus of claim 7, wherein said nonlinear secondary path is modeled using THF.

9. The apparatus of claim 6, wherein said active noise control system comprises feedforward architectures and feedback architectures for both single systems and multivariable systems.

10. The apparatus of claim 9, wherein said first transducer and said second transducer are a microphone.

11. A self-tuned method for controlling active noise by compensating for at least one secondary path non-linearity caused by at least one saturation effect in an active noise control system, said method comprising the steps of:

modeling said at least one secondary path non-linearity with saturation nonlinearity in at least one of a loudspeaker and/or a power amplifier;

evaluating a degree of nonlinearity from an identified secondary path model;

determining at least one control algorithm for saturation nonlinearity in said at least one of said loudspeaker and/or said power amplifier;

said at least one control algorithm determined is nonlinear FXLMS family of algorithms; and iteratively designing the nonlinear FXLMS family of algorithms using an information of said degree of nonlinearity until a noise controlling module converges; and applying said noise controlling module to reduce noise heard by a subject user.

12. The method of claim 11, wherein a nonlinear secondary path and said degree of nonlinearity are modeled using tangential hyperbolic function (THF).

13. A self-tuned method for controlling active noise by compensating for at least one secondary path non-linearity caused by at least one saturation effect in an active noise control system, said method comprising the steps of:

modeling said at least one secondary path non-linearity with saturation nonlinearity in at least one of a loudspeaker and/or a power amplifier;

evaluating a degree of nonlinearity from an identified secondary path model;

determining at least one control algorithm for saturation nonlinearity in said at least one of said loudspeaker and/or said power amplifier;

said at least one control algorithm determined is Leaky FXLMS family of algorithms and/or Minimum output variance FXLMS family of algorithms;

collecting an output signal from a primary path;

computing an energy of the collected output signal from said primary path;

computing an optimum leakage factor using said energy of said output signal of said primary path and said degree of nonlinearity;

applying an optimal leakage factor in forming at least one of said Leaky FXLMS family algorithms and said Minimum output variance FXLMS family of algorithms; and storing said Leaky FXLMS family algorithms and/or said Minimum output variance FXLMS family of algorithms in a processor of a noise controlling module.

14. The method of claim 13, wherein said active noise control system comprises feedforward architectures and feedback architectures for both single systems and multivariable systems.

15. The method of claim 13, wherein a nonlinear secondary path and said degree of nonlinearity are modeled using tangential hyperbolic function (THF).

16. A self-tuned method for controlling active noise by compensating for at least one secondary path non-linearity caused by at least one saturation effect in an active noise control system, said method comprising the steps of:

modeling said at least one secondary path non-linearity with saturation nonlinearity in at least one of a loudspeaker and/or a power amplifier;

evaluating a degree of nonlinearity from an identified secondary path model;

determining at least one control algorithm for saturation nonlinearity in said at least one of said loudspeaker and/or said power amplifier, wherein modeling said at least one secondary path nonlinearity with saturation nonlinearity is performed by selecting one of a Hammerstein model structure and a Wiener model structure in the presence of said at least one of said loudspeaker and/or said power amplifier.

17. The method of claim 16, wherein said at least one control algorithm determined is nonlinear FXLMS family of algorithms.

18. The method of claim 16, wherein said at least one control algorithm determined is Leaky FXLMS family of algorithms and/or Minimum output variance FXLMS family of algorithms.

19. The method of claim 16, wherein said active noise control system comprises feedforward architectures and feedback architectures for both single systems and multivariable systems.

20. The method of claim 16, wherein a nonlinear secondary path and said degree of nonlinearity are modeled using tangential hyperbolic function (THF).

* * * * *